US005590920A

United States Patent [19]

Anderson et al.

[11] Patent Number: 5,590,920

[45] Date of Patent: Jan. 7, 1997

[54] FLOOR-MOUNTABLE RETRACTABLE ROLLER DEVICE

[76] Inventors: Brian W. Anderson, 431 W. 19th St.; David A. Push, 448 E. 1st St., both of Fremont, Nebr. 68025

[21] Appl. No.: 219,034

[22] Filed: Mar. 28, 1994

[51] Int. Cl.[6] ..... E05C 3/12

[52] U.S. Cl. ..... 292/219; 292/DIG. 15; 292/193

[58] Field of Search ..... 292/193, 198, 292/219, 338, DIG. 15, DIG. 19

[56] References Cited

U.S. PATENT DOCUMENTS

| | | | |
|---|---|---|---|
| 391,682 | 10/1888 | Brohard | 292/219 |
| 614,741 | 11/1898 | Moore | 292/219 |
| 629,753 | 7/1899 | Ocumpaugh | 292/219 |
| 1,015,424 | 1/1912 | Cline | 292/DIG. 15 X |
| 1,424,673 | 8/1922 | Ordendorff | 292/87 |
| 2,941,831 | 6/1960 | Borsani | 292/DIG. 15 X |
| 2,973,215 | 2/1961 | Johnson | 292/DIG. 19 X |
| 3,116,946 | 1/1964 | Deloume | 292/DIG. 15 X |
| 3,656,787 | 4/1972 | Coopersmith | 292/DIG. 53 |
| 4,196,924 | 4/1980 | Iseki | 292/DIG. 19 X |
| 4,598,499 | 7/1986 | Viner | 249/411 |

*Primary Examiner*—Steven N. Meyers
*Assistant Examiner*—Monica E. Millner
*Attorney, Agent, or Firm*—George R. Nimmer

[57] ABSTRACT

Environmentally employable in combination with a slidable-door type open-wall and for maintaining an angular-dog type slidable-door in tight opening-obstructed temperature-protective contact adjacently about the wall-opening of a said upright open-wall, a floor-mountable retractable roller device including a floor-mountable horizontal base-plate and including a pivotably mounted elongate rear-arm having a rotatable horizontal-roller springably urged toward the slidable-door underlying angular-dog to temperaturely-protectively urge the slidable-door in closure-condition about the wall-opening. The springably urged force between the slidable-door lower angular-dog and the device horizontal-roller can be empirically adjusted with an adjusting screw disclosed herein.

4 Claims, 4 Drawing Sheets

FLOOR-MOUNTABLE RETRACTABLE ROLLER DEVICE

BACKGROUND OF THE INVENTION

Building structures having horizontal-floors and upright open-walls oftentimes include an upright slidable-door horizontally movable across the wall-opening of an upright-wall having opposed upright surfaces. It is customarily required that the temperature-gradient between the upright-wall opposed parallel surfaces be protectively minimized whenever the slidable-door is placed horizontally across the wall-opening, and in this regard, prior art workers have sought to attain a tight opening-obstructed contact between the slidable-door's upright rearward-plane and the upright-wall peripherally about the entrance/egress wall-opening thereof.

OBJECT OF THE INVENTION

In view of the foregoing, it is the general objective of the present invention to provide improved apparatus and method for attaining heretofore unattained tight opening-obstructed peripheral temperature-gradient-protective contact between a slidable-door's upright rearward-surface and the wall-opening border of an upright-wall structural environment.

GENERAL STATEMENT OF THE INVENTION

With the above general objective in view, and together with other ancillary and specific objectives which will become more apparent as this description proceeds, this invention provides a novel "floor-mountable retractable roller device" comprising: a horizontal base-plate mountably superimposable upon a horizontal-floor and having a horizontal upper-plane located above a said horizontal-floor; a horizontally elongate rear-arm having a trail-end portion overlying and pivotably attached to an upright rear-station of said base-plate and having a lead-end provided with a horizontal-roller impingeable toward a lower angular dog of a slidable-door having opening-obstructed condition with a wall-opening; a springsupport extending uprightly from the base-plate; a helical extending horizontally from said springsupport to the trailing-end of a horizontal front-arm overlying said base-plate; said front-arm extending horizontally along a front arm-axis toward a front-arm leading-end for a finite-length and being leadwardly pivotably attached to a mid-part of said rear-arm; extending uprightly from the base-plate and directionally forwardly of said rear-arm, a rear-arm intrusive stop-means whereby said helical spring through said front-arm tends to maintain the horizontal-roller abuttably toward the slidable-door underlying angular dog to thusly maintain the closed-condition slidable-door in tight opening-obstructed peripheral contact about the wall-opening to protect the upright-wall temperature-gradient; and preferably also, means for adjusting the front-arm axial-length to control the degree of force impingeable by a said rear-arm horizontal-roller against the underlying angular dog of a said slidable-door toward a said upright-wall peripherally about a wall-opening thereof.

BRIEF DESCRIPTION OF THE DRAWING

In the drawing, wherein like characters refer to like parts in the several views, and in which.

DETAILED DESCRIPTION OF THE DRAWING

Figure 1:
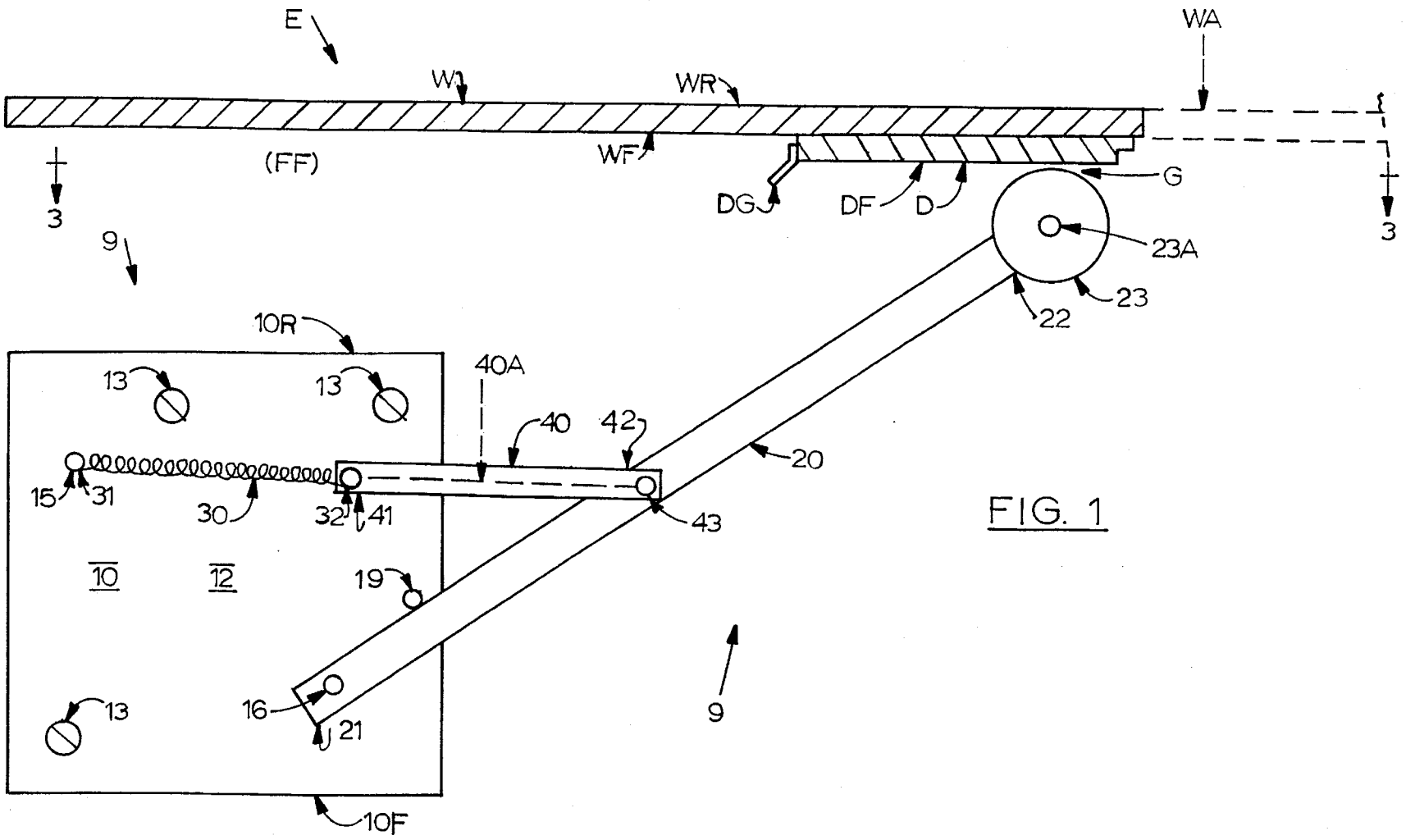
FIG. 1 is a top plan view of a representative embodiment (9) of the "floor-mountable retractable roller device" of the present invention and appropriately located at an open-wall environment (E) and at which environment the representative embodiment (9) is in a "ready condition" ready to maintain the environmental slidable-door portion tightly against the wall-opening portion of a said environment.

Environmentally, for the novel "floor-mountable retractable roller device" (e.g. 9), of the present invention, there is an environmental slidable-door type open-wall (E) comprising an upright-wall (W) extending uprightly from a horizontal-floor substrate (FF) and which has an upright frontal-plane WF that is directionally horizontally interrupted by an uprightly extending wall-opening WA. Said open-wall environment (E) also includes an upright slidable-door D extending along an upright rearward-plane DR provided therethrough with a door-closeable opening-nonobstructed (FIG. 1) and door-opening-obstructed condition (FIG. 2) conditions. The environmental slidable-door portion (D) immediately above horizontal-floor (FF) is equipped with an angular dog DG extending directionally forwardly transversely horizontally from a forward-plane DF of a said slidable-door D.

For a said environment (F), representative embodiment (9) of the "floor-mountable retractable roller device" of the present invention, and employable for tightly maintaining environmental slidable-door D abuttably peripherally against environmental wall-opening WA in door-opening-obstructed condition (FIG. 2) primarily comprises a laminar base-plate 10 having a horizontal lower-plane (11) located below said angular dog (DG) and mountably super mposeable upon a horizontal-floor (FF) forwardly of environmental open-wall (E), In this regard, base-plate 10 includes:

a horizontal rear-side 10R immediately parallely confronting a said environment (E);

a horizontal front-side 10F located finitely transversely for-forwardly of base-plate rear-side 10R;

a horizontal upper-plane 12 overlying a said lower-plane 11;

mounting means (e.g. screws 13, etc. ) for mounting base-plate 10 to a horizontal-floor (FF);

extending rigidly uprightly from upper-plane 12 and located much nearer to front-side 10F than to rear-side 10R, a preferably peg-like rear-station 16;

extending rigidly uprightly from upper-plane 12 and located much nearer to rear-side 10R than to front-side 10F, a preferably peg-like springsupport means 15; and extending rigidly uprightly from upper-plane 12 and located directionally transversely between a said rear-station (16) and a said springsupport means (15), a preferably peg-like stop-means at the rearside of a horizontally elongate rear-arm 20 overlying base-plate 10 and having a trail-length part (21) pivotably attached to a said rear-station (16).

A helical spring 30 horizontally overlies the base-plate (10) and includes a trailward-end part 31 attached to a spring-support means (15).

Moreover, and common to both said door-opening-non-obstructed "ready condition" (FIG. 1) and to said door-opening-obstructed "actuated condition" (FIG. 2), the said "floor-mountable retractable roller device" representative embodiment (9) comprises:

(i) a horizontally elongate rear-arm 20 extending horizontally obliquely forwardly from its pivotably-secured trail-end length (21) toward a lead-end length (22) thereof that is located directionally ally transversely between base-plate rear-side 10R and environmental open-wall (E) and which rear-arm is leadwardly provided with a horizontal-roller 23 that is revolvable about an upright roller-axis 23A; and (ii) a horizontally elongate front-arm 40 overlying base-plate 10 and horizontally extending along a frontarm-axis 40A for a finite-length between a front-arm trailing-end portion connection (33) to a spring member leadward-end portion (32) and a front-arm leading-end portion (42) pivotal (43) to said rear-arm at a location intermediately between trail-end length (21) and lead-end length (22). The pivotal connection (43) and between rear-arm 20 and front-arm 40 is also located transversely rearwardly of a said base-plate upright stop-means (19).

Figure 2:
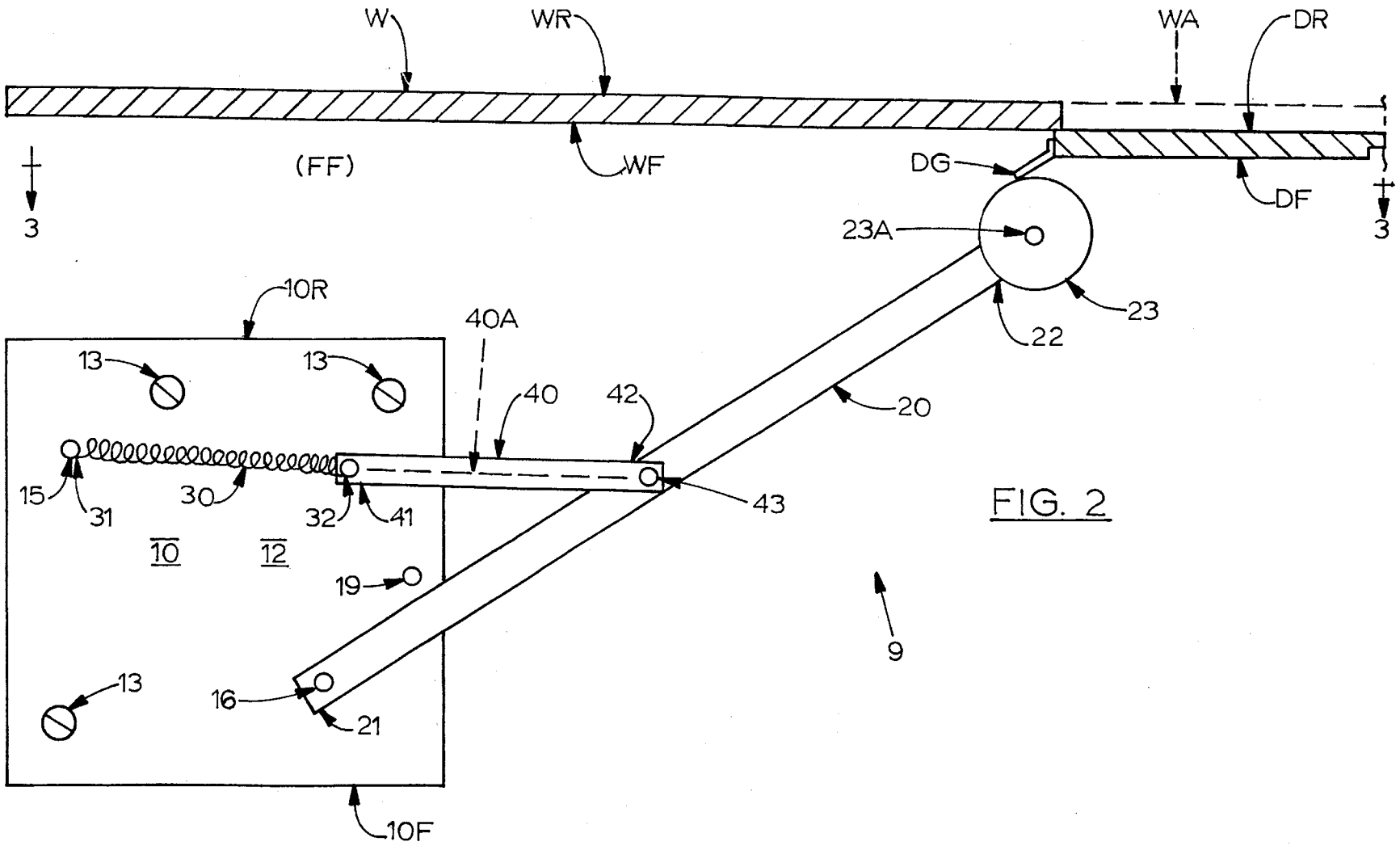
FIG. 2 is a top plan view of representative embodiment (9) and in an "actuated condition" actually maintaining the environmental slidable-door portion tightly around the wall-opening portion of a said open-wall environment.
Figure 3:
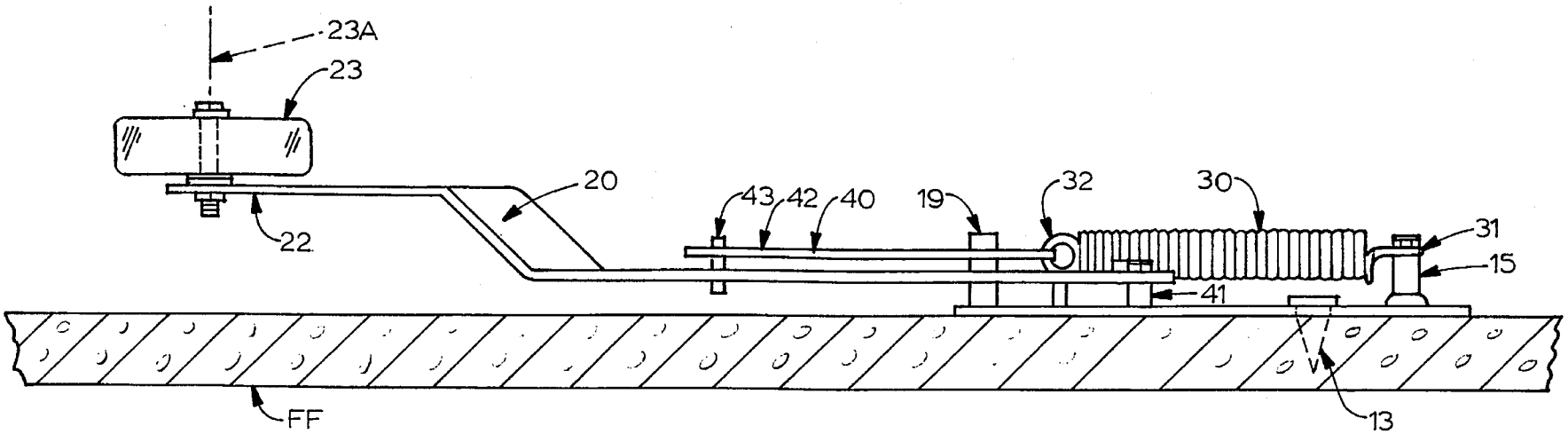
FIG. 3 is a sectional elevational view taken along lines 3–3 of FIGS. 1 and 2.

In view of the recitations made in sub-paragraphs (i) and (ii) of the instant paragraph, it will be readily appreciated that the aforedescribed roller part (23) will be resiliently manually urged (30) toward the environmental open-wall (E) and especially toward the slidable-door dog (DG) at the "ready-condition" (FIG. 1) and at the "actuated-condition" (FIG. 2).

And also explanatory of the conclusionatory remarks of the immediately preceeding paragraph, it will also be readily appreciated that at the FIG. 1 "ready-condition", wherein the upright slidable-door (D) is at open-condition (i.e. away from environmental wall-opening WA), the slidable-door's forwardly-extending lower-dog (DG) is not in transverse alignment with the apparatus (9) whereby a finite-gap (G) exists between horizontal-roller (23) and the slidable-door's upright forward-plane (DF).

And also explanatory of the conclusionatory remarks of the second immediately preceeding paragraph hereabove, it will also be readily appreciated that at the FIG. 2 "actuated-condition", wherein the slidable-door (D) is brought to a closed-condition (i.e. manually horizontally moved adjacently forwardly of the environmental wall-opening WA), (i) the slidable-door forwardly-extending lower-dog (DG) becomes in transversely alignment abutment with the apparatus horizontal-roller (23) whereby the slidable-door's rearward-plane (DR) tightly abuts the wall-framework about environmental wall-opening WA; and (ii) whereby, because of the resultant tightly abutting relationship between the slidable-door's rearward-plane (DR) and the wall-framework peripherally about environmental wall-opening WA, differential temperatures existing between wall upright surfaces (WR, WF) are meritoriously protected.

The aforementioned meritorious protection of the temperature differential is at least partially dependent upon the degree of force empirically effected between the base-plate springsupport-means (15) and the front-arm pivital-connection (43) to the rear-arm. Such empirically provided force might be alternatively provided: by empirical selection of the helical spring resiliency (30); or, by empirically selecting the front-arm axial-length (40A) between its terminii (41, 42). Inasmuch as the latter alternative is preferable from the economic and operational standpoints, the adustable-length front-arm alternative embodiment 400 of FIGS. 4A and 4B will be described in the immediately ensuing paragraph.

Figure 4B:
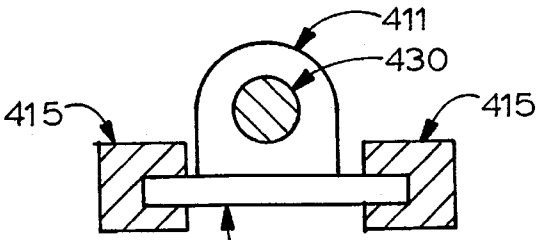
FIG. 4B is a sectional elevational view taken along line 4B—4B of FIG. 4A.
Figure 4A:
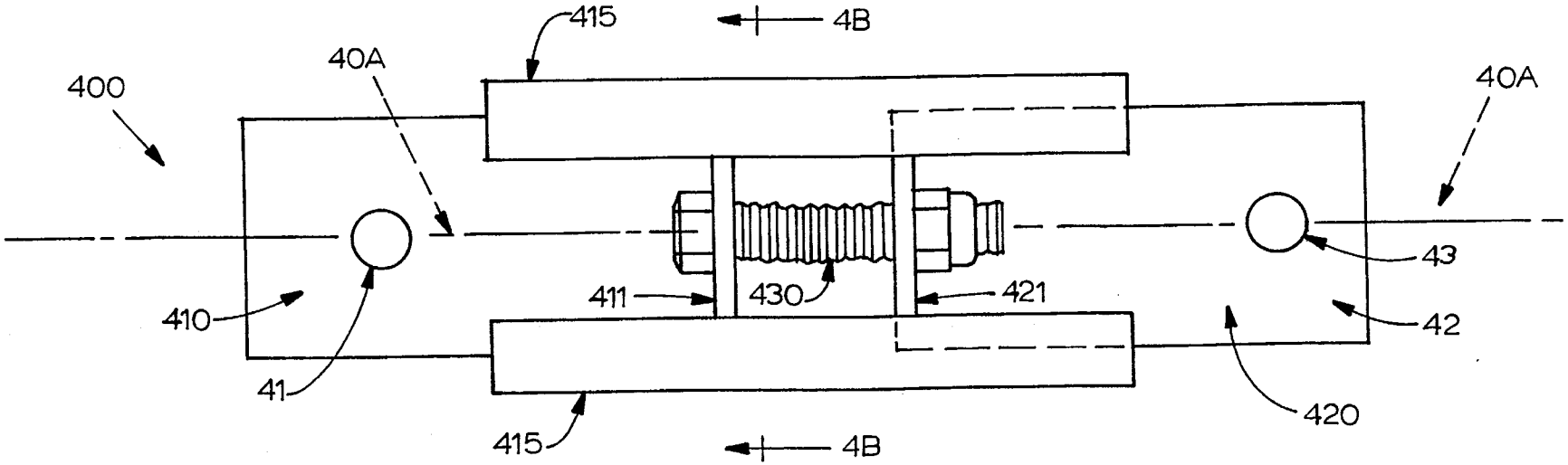
FIG. 4A is a top plan view of an axially adjustable-length front-arm component (400), as an alternative to the front-arm component (40) for the FIGS. 1–3 primary representative embodiment (9)

The empirically adjustable-length (40A) front-arm 400 depicted in FIGS. 4A and 4B comprises two separate parts (410, 420) slidably adjustably (430) horizontally extending along axis 40A for an adjustable front-length frontarm-length 40A (i.e. from 41–42). In this regard, there is described: a horizontal frontal-leg 420 that is pivotably attached (43) to a said rear-arm 20 and having a centrally-threaded upturned-end 421; and a rearward-leg 410 that is attached (41) to a said helical spring (30, 32) and having a horizontally centrally-threaded upturned-end 411 confronting the other upturned-end 421; and a horizontal adjusting-screw 430 threadedly passing through said centrally-threaded upturned-ends 411 and 421, whereby adjusting-screw 430 is capable of adjusting the frontarm-length 41–42 along axis 40A of front-arm embodiment 400.

From the foregoing, the construction and operation of the "floor-mountable retractable roller device" will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

We claim:

1. In environmental combination with a floor adjacent an open wall having a slidable-door therein, wherein said slidable-door has a frontal-plane, said frontal-plane of said slidable-door extending upwardly above said floor and being provided with a forwardly extending angular dog whose longitudinal direction is transverse and adjacent said floor and including a mountable retractable roller device mounted upon said floor and including a horizontal-roller extending toward said angular dog to maintain said slidable-door against said open-wall, and comprising:

(A) a base-plate having a horizontal lower-plane mounted on said floor and having a horizontal rear-side confronting said slidable-door frontal-plane, a horizontal front-side located forward of said base-plate rear-side, and extending parallel said base-plate rear-side;

(B) a horizontally elongate rear-arm having a trail-end portion pivotably attached in overlying relationship to said base-plate at an upright pivotal rear-station wherein said rear-arm extends forward from said trail-end toward a rear-arm lead-end there at provided with a horizontal-roller confrontably impinging against a said slidable-door angular dog;

(C) a spring-support means which extends from said base-plate;

(D) a helical spring horizontally overlying the base-plate upper-plane and extending horizontally from said spring-support means to a rearward-leg of a horizontal front-arm that overlies said base-plate;

(E) said horizontal front-arm extending horizontally along a front arm-axis thereof between a frontal-leg portion pivotably attached to said rear-arm and the rearward leg portion being slidable and adjustable where it is attached to said helical spring; and (F) extending upright from said base-plate upper-plane and transversely extending between said rear-arm and the base-plate rear-side, a stop-means abutting said rear-arm, whereby said horizontal helical spring through said pivotably associated front-arm tends to maintain said horizontal-roller transversely impingeable toward the angular dog portion of said slidable-door.

2. The floor-mountable retractable roller device of claim 1 wherein said frontal-arm rearward-leg and frontal-leg are respectively provided with confronting upturned-ends adjustably connected with an adjusting-screw.

3. The "floor-mountable retractable roller device" of claim 1 wherein said front-arm along said frontarm-axis includes a frontal-leg that is pivotably attached to said rear-arm; wherein said front-arm along said frontarm-axis includes a rearward-leg that is attached to said helical spring; and wherein the said frontal-leg is slidably associated with said rearward-leg along the direction of said frontarm-axis.

4. The "floor-mountable retractable roller device" of claim 1 wherein the the front-arm frontal-leg is rearwardly provided with an upstanding and horizontally centrally-threaded frontal-lug; wherein the front-arm rearward-leg is forwardly provided with an upstanding and horizontally centrally-threaded rearward-lug; and wherein a horizontally-extending adjusting-screw is adjustably threadely engaged with the centrally-threaded portions of said upstanding frontal-lug and rearward-lug to govern the slidable relationship between the frontal-leg and rearward-leg portion of said slidably-provided front-arm.

* * * * *